US006679769B2

(12) United States Patent
Pinheiro et al.

(10) Patent No.: US 6,679,769 B2
(45) Date of Patent: Jan. 20, 2004

(54) POLISHING PAD HAVING AN ADVANTAGEOUS MICRO-TEXTURE AND METHODS RELATING THERETO

(75) Inventors: Barry Scott Pinheiro, Media, PA (US); Steven Naugler, Hockessin, DE (US); Mary Jo Kulp, Macungis, PA (US)

(73) Assignee: Rodel Holdings, INC, Wilmington, DE (US)

( * ) Notice: Subject to any disclaimer, the term of this patent is extended or adjusted under 35 U.S.C. 154(b) by 142 days.

(21) Appl. No.: 09/775,972

(22) Filed: Feb. 2, 2001

(65) Prior Publication Data

US 2002/0058469 A1 May 16, 2002

Related U.S. Application Data

(63) Continuation-in-part of application No. 09/693,401, filed on Oct. 20, 2000.
(60) Provisional application No. 60/233,747, filed on Sep. 19, 2000.

(51) Int. Cl.[7] ..... B24D 3/28
(52) U.S. Cl. ..... 451/526; 51/298
(58) Field of Search ..... 51/298, 293; 451/526, 451/921, 53, 56, 72, 443

(56) References Cited

U.S. PATENT DOCUMENTS

| | | | | |
|---|---|---|---|---|
| 2,167,215 A | * | 7/1939 | Leary | 62/320 |
| 4,271,639 A | * | 6/1981 | Talalay et al. | 451/53 |
| 4,841,680 A | * | 6/1989 | Hoffstein et al. | 451/41 |
| 5,081,051 A | | 1/1992 | Mattingly et al. | |
| 5,300,155 A | | 4/1994 | Sandhu et al. | |
| 5,569,062 A | | 10/1996 | Karlsrud | |
| 5,749,772 A | | 5/1998 | Shimokawa | |
| 5,893,754 A | | 4/1999 | Robinson et al. | |
| 5,981,396 A | | 11/1999 | Robinson et al. | |
| 5,990,010 A | | 11/1999 | Berman | |
| 6,017,265 A | | 1/2000 | Cook et al. | |
| 6,020,262 A | | 2/2000 | Wise et al. | |
| 6,077,151 A | | 6/2000 | Black et al. | |
| 6,106,754 A | | 8/2000 | Cook et al. | |

FOREIGN PATENT DOCUMENTS

| | | | | |
|---|---|---|---|---|
| EP | 0 849 041 A2 | | 6/1998 | |
| EP | 0940 222 A2 | | 9/1999 | |
| JP | 0071661 | * | 3/1989 | 51/293 |
| WO | WO 97/44160 A1 | | 11/1997 | |
| WO | WO 99/07515 A1 | | 2/1999 | |
| WO | WO 99/33615 A1 | | 7/1999 | |

OTHER PUBLICATIONS

Stein, David; Hetherington, Dale; Dugger, Mike; Stout, Tom, "Optical Interferometry for Surface Measurements of CMP Pads", Journal of Electronic Materials, vol. 25, No. 10, Oct. 1996, pp. 1623–1627.

* cited by examiner

*Primary Examiner*—Robert A. Rose
(74) *Attorney, Agent, or Firm*—Gerald K. Kita; Blake T. Biederman; Edwin Oh

(57) ABSTRACT

This invention relates to polishing pads and a method for making the polishing pad surface readily machineable thereby facilitating permanent alteration of the polishing pad surface to create an advantageous micro-texture. The advantageous micro-texture is statistically uniform and provides a polishing pad with improved break-in preconditioning time. Polishing pads of this invention find application to the polishing/planarization of substrates such as glass, dielectric/metal composites and substrates containing copper, silicon, silicon dioxide, platinum, and tungsten typically encountered in integrated circuit fabrication.

8 Claims, 5 Drawing Sheets

Figure 1. Bearing Ratio Curve

Storage Modulus (E') vs. Temperature

Figure 3. Single-Point Cutting Tool

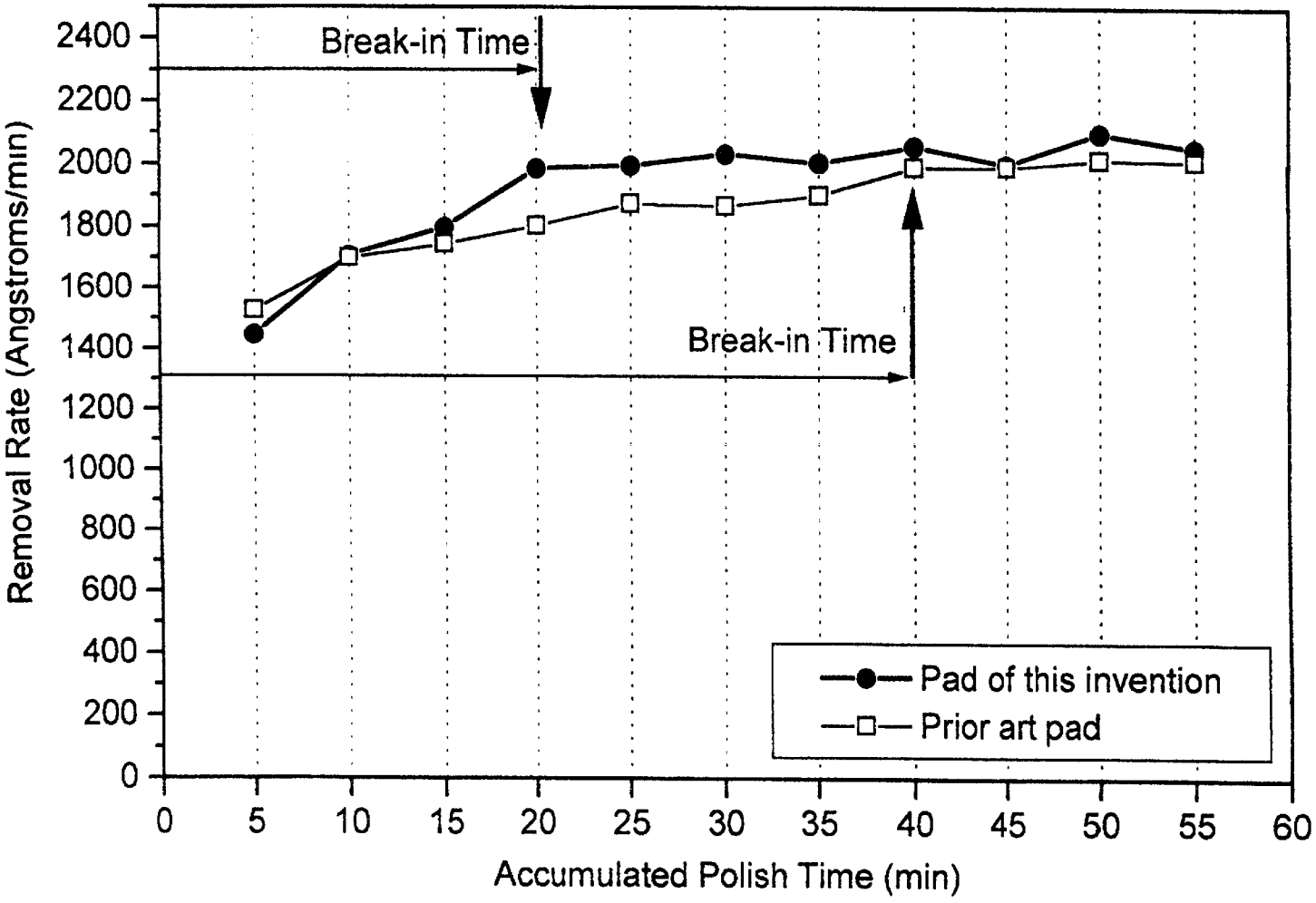
Figure 7. Removal Rate for the Pad of this Invention as compared to a Prior Art Pad

POLISHING PAD HAVING AN ADVANTAGEOUS MICRO-TEXTURE AND METHODS RELATING THERETO

This utility application is a continuation-in-part of U.S. nonprovisional patent application Ser. No. 09/693,401 filed on Oct. 20, 2000 which claims the benefit of U.S. provisional patent application Ser. No. 60/233,747 filed on Sep. 19, 2000.

This invention relates to polishing pads and a method for making a polishing pad surface readily machineable thereby facilitating permanent alteration of the polishing pad surface by machining to create an advantageous micro-texture. Polishing pads of this invention find application to the polishing/planarization of substrates such as glass, dielectric/metal composites and substrates containing copper, silicon, silicon dioxide, platinum, and tungsten typically encountered in integrated circuit fabrication.

U.S. Pat. No. 5,749,772 describes conditioning a pad using a temperature-controlled conditioning disc to enable uniform chemical mechanical polishing (CMP) at a stable temperature.

U.S. Pat. No. 5,569,062 describes a cutting means for abrading the surface of a polishing pad during polishing. U.S. Pat. No. 5,081,051 describes an elongated blade having a serrated edge pressing against a pad surface thereby cutting circumferential grooves into the pad surface.

U.S. Pat. No. 5,990,010 describes a preconditioning mechanism or apparatus for preconditioning a polishing pad. This apparatus is used to generate and re-generate micro-texture during polishing pad use.

Embodiments of this invention will now be described by way of example with reference to the accompanying drawings.

FIG. 7 is a graph plotting the removal rate (y-axis) of a wafer oxide layer in Angstroms per minute, against the accumulated polishing time in minutes (x-axis) for an as-manufactured polishing pad according to this invention.

Figure 1:
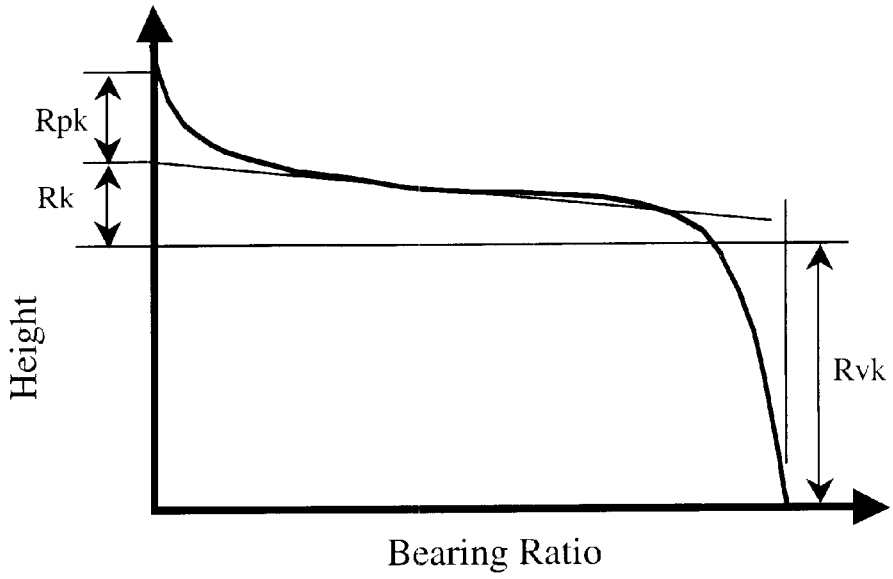
FIG. 1 is a graph that shows the bearing ratio curve.

During a polishing process using new polishing pads to polish a material, such pads undergo a characteristic "break-in" period typically manifested by a low rate of material removal, followed by a rise in the rate of material removal, until leveling off at a desired high removal rate. The break-in period typically lasts from about 10 minutes to more than one hour, in different cases, and represents a significant loss in production efficiency. Continuous monitoring of the polishing operation is required during the break-in period to determine whether sufficient polishing has been completed. Polishing pads having a smooth surface typically require longer break-in periods than polishing pads that have been machined to provide the pads with a surface texture.

It is thus desirable to shorten the break-in period of an as-manufactured polishing pad. In an embodiment, the method of this invention provides a polishing pad with a micro-texture that provides steady material removal rates from the start of the polishing process. Further, this invention provides a certain degree and type of surface texture to exhibit relatively high removal rates. Preferably, the micro-texture according to this invention comprises micro-indentations and micro-protrusions. The micro-protrusions preferably have a height of less than 50 microns and yet more preferably less than 10 microns. Micro-indentations have an average depth of less than 50 microns, and yet more preferably less than 10 microns.

In an embodiment, the present invention provides a polishing pad and a method to make the surface of the polishing pad more machineable to enable permanent alteration of the polishing pad surface to obtain an advantageous micro-texture. The polishing pads of this invention have shorter break-in periods than do prior known polymeric polishing pads.

A surface texture on the surface of a polishing pad according to the present invention is fabricated prior to polishing, preferably during manufacturing, and preferably prior to use of the polishing pad. In an embodiment, the surface texture according to the present invention, is a micro-texture provided on a polishing pad surface. In an alternate embodiment, the surface texture is a combination of micro-texture and macro-texture provided on a polishing pad surface. The macro-texture comprises either perforations through the polishing pad thickness or surface groove designs. Details of groove designs and groove dimensions for use in the polishing pad of this invention are found in pending patent application Ser. No. 09/631,783 filed on Aug. 3, 2000 herein incorporated by reference.

A preferable micro-texture, according to this invention, is statistically uniform, produced upon the entire polishing pad surface (alternately referred to as the surface of the polishing layer of the polishing pad) by machining and has the following identifying parameters:

Arithmetic Surface Roughness, Ra, from 0.01 $\mu$m to 25 $\mu$m;

Average Peak to Valley Roughness, Rtm, from 2 $\mu$m to 40 $\mu$m;

Core roughness depth, Rk, from 1 $\mu$m to 10 $\mu$m;

Reduced Peak Height, Rpk, from 0.1 $\mu$m to 5 $\mu$m;

Reduced Valley Height, Rvk, from 0.1 $\mu$m to 10 $\mu$m; and

Peak density expressed as a surface area ratio, $R_{SA}$, ([Surf.Area/(Area—1)]), 0.001 to 2.0.

Typically, surface texture on a polishing pad comprises peaks (or protrusions) and valleys (or indentations) and aids the polishing process in the following ways: 1) the valleys act as reservoirs to hold "pools" of polishing slurry (also referred to herein as slurry) so that a constant supply of slurry is available for contact with the surface of the substrate being polished; 2) the peaks come in direct contact with the substrate surface causing "two-body abrasive wear" and/or in conjunction with the slurry particles causing "three-body abrasive wear"; and 3) the texture of the surface acting in conjunction with the shear on the slurry causes eddy currents in the slurry creating wear of the substrate surface by erosion.

Parameters used to identify one or more of the advantageous micro-textures obtained by this invention include: Surface Roughness ("Ra"); Average Peak to Valley Roughness ("Rtm"); Core Roughness Depth ("Rk"); Reduced Peak Height ("Rpk"); Reduced Valley Height ("Rvk"); and Peak Density ("$R_{sa}$").

Surface Roughness, Ra, describes the average deviation of the pad surface from the average amplitude or height of the surface features. Since two drastically different surfaces could have the same Ra values, additional parameters are necessary to better quantify polishing pad surface micro-texture for practising this invention.

Average Peak to Valley Roughness, Rtm, is a measure of the relative number of peaks and valleys. Peak to valley height characterizes both the height of the peaks and the depth of the valleys in the surface texture. The thickness of the slurry layer (and/or depth of a local pool of slurry) influences the dynamics of slurry and particle flow within the slurry, i.e. whether the flow is laminar or turbulent, the aggressiveness of the turbulence, and the nature of eddy currents. The dynamics of slurry flow is important as it relates to wear of the substrate surface by erosion.

Valley size indicates the ability of the polishing pad surface to retain "pools" of slurry as well as the quantity of slurry locally available to perform polishing of the substrate surface. As a relatively large substrate (for e.g. a wafer 200 to 300 mm in diameter) passes over a polishing pad it is important to have the slurry available at all points under the wafer to ensure uniformity of polishing. If the polishing pad surface were featureless it would be difficult for the slurry to penetrate under the wafer to be available in the interior portions of wafer. In this scenario, the contact area between the pad and the wafer becomes "slurry starved". Macroscopic features such as grooves enable slurry flow between the polishing layer of the polishing pad and the wafer. On a microscopic scale, if the surface of the land area between grooves or perforations in the polishing pad is too smooth (analogous to a featureless pad on a macroscopic scale), the local area of contact between the pad and wafer can similarly become slurry starved. It is therefore important to have smaller-scale surface texture (i.e., micro-texture) which is capable of locally retaining slurry to make it available on these smaller size scales.

Peak (or protrusion) size is important because it affects the rigidity of the peak; a tall narrow peak is more flexible than a broader one. The relative rigidity of a peak affects the influence of the abrasive wear component of polishing. Peak and valley size and shape are cooperatively characterized through $R_{pk}$ (reduced peak height), $R_{vk}$ (reduced valley depth), and $R_k$ (core roughness depth). These three values are obtained from the bearing ratio curve, as shown in FIG. 1. The bearing ratio is used in tribological studies. More details may be found in "Tribology: Friction and Wear of Engineering Materials, I. M. Hutchings, page 10, 1992. The relevant text from this textbook is presented here for easy reference: "The bearing ratio curve can be understood by imagining a straight line, representing the profile of the surface under investigation. When the plane first touches the surface at a point, the bearing ratio (defined as the ratio of the contact length to the total length of the profile) is zero. As the line is moved further downwards, the length over which it intersects the surface profile increases, relating to a higher bearing ratio. Finally, as the line reaches the bottom of the deepest valley in the polishing pad surface profile, the bearing ratio rises to 100%." The bearing ratio curve is a plot of bearing ratio versus surface height, as shown in FIG. 1.

Peak density indicates how may peaks (protrusions) are available to be in contact with the surface of the substrate being polished. For a given downforce on the polishing pad (the pressure with which the substrate is contacted with the polishing layer of the polishing pad), a low peak density in the polishing pad surface would result in fewer contact points with the surface of the substrate being polished. Thus, each contact point would exert greater pressure on the substrate surface. In contrast, a higher peak density would imply numerous contact points with almost uniform pressure being exerted on the substrate surface. Peak density is characterized through the surface area ratio ("$R_{SA}$") which is defined as [Surface Area/(Normal Area—1)], wherein, surface area is the measured surface area, and normal area is the area projected on a normal plane.

Figure 2:
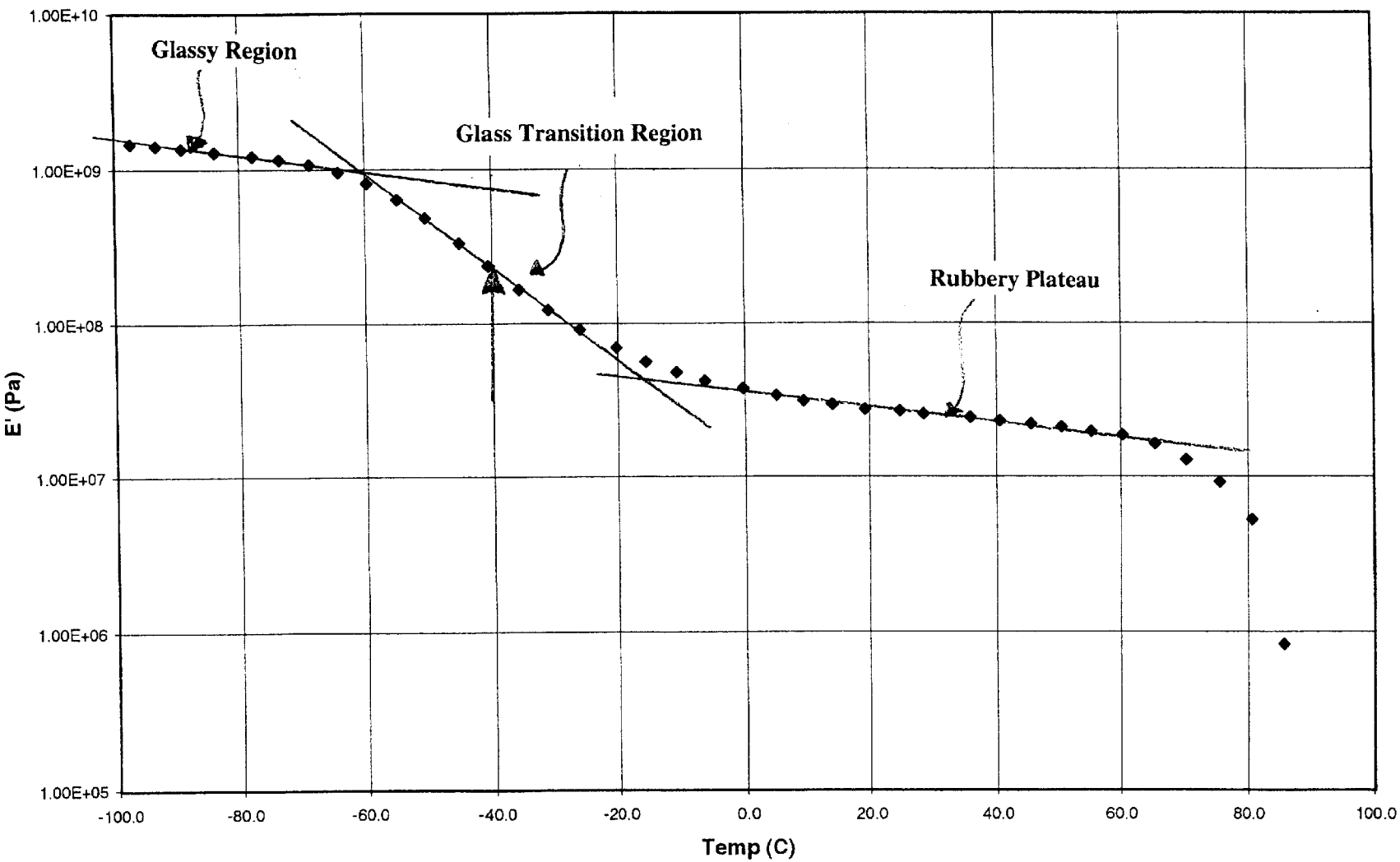
FIG. 2 is a graph that illustrates variation of the storage modulus of a polyurethane with temperature.

Polymer viscoelastic behavior as a function of temperature is generally categorized into different regions including glassy, glass transition, rubbery plateau, rubbery flow and liquid flow. At very low temperatures, polymers behave as glassy solids, having a high E', or storage modulus. As the polymer is heated, molecular mobility increases with a concomitant decrease in E'. The beginning of the decrease in E' can be used to indicate the onset of the glass transition region and the area at higher temperature where E' again changes little as a function of temperature in the rubbery plateau, is used as the end of the glass transition region. The midpoint of this sloped region of the E' curve, is qualitatively identified as a particular polymer's $T_g$. At temperatures above the glass transition region, in the rubbery plateau region, the polymer is elastic and its response to applied stress is relatively invariant as a function of temperature. At still higher temperatures are the rubbery flow region, where the polymer exhibits both flow and elastic properties, followed by the liquid flow region where the polymer flows readily. The storage modulus, E', is the part of the energy required to deform a polishing pad that is recoverable. If a periodic, sinusoidal, external force is applied to a polishing pad, the storage modulus is expressed as:

$$E'=\sigma_0/\epsilon_0\cos\delta,$$

where,

E'=storage modulus $\sigma_0$=the amplitude of the dynamic tensile stress, $\epsilon_0$=the maximum amplitude of the dynamic tensile strain, and $\delta$=the phase angle of the the strain lag The variation of the storage modulus, E', with temperature for a polyurethane polishing pad is illustrated in FIG. 2, with the relevant visco-elastic regions identified.

In an embodiment, the polishing pad of this invention, comprises hard and soft segments with glass transition temperatures near 200° C. and −80° C., respectively. Lowering the temperature of the polishing pad surface to approach the onset of the lower $T_g$ makes the pad surface harder and hence more machineable. In an embodiment, the polishing pad of this invention comprises a phase-separated mixture of various polymers with multiple, discrete, $T_g$ values. In another embodiment, the polishing pad of this invention comprises a mixed system having a single $T_g$ with either a narrow or broad glass transition region.

The method step of lowering the temperature of the polishing pad surface is performed by intimate contact of the polishing pad surface with supercritical carbon dioxide, liquid nitrogen, iced water and other cold liquids. Cold liquids as defined herein include, but is not limited to dry ice and solvent mixtures, cold slurries, water and ice mixtures and other such cold materials. Solvents for use in this application include alcohols, ethers, water and other environmentally benign equivalents. The lower temperature results from heat transfer between the polishing pad surface and the cold material. Other processes such as evaporative cooling of solvents applied to the polishing pad surface result in lowering the temperature of the polishing pad surface.

The method step of lowering the temperature of the polishing pad surface is performed until the pad temperature is lowered toward, and approaching the onset of glass transition of at least one of the polymers comprising the polishing pad matrix thereby making the polishing pad surface substantially machineable. The polishing pad surface becomes harder and thus more amenable to machining so that either a preferred micro-texture or one of the preferred combinations of micro-texture and macro-texture is imparted to the polishing pad surface by permanent deformation of the polishing pad surface.

The desired surface texture features are provided on the polishing pad surface by machining the pad surface after rendering or making the polishing pad surface more machineable. The term "machining" includes cutting or deforming the polishing pad surface by tools; chemical removal of material from the polishing pad surface by etching; material removal by radiation such as laser ablation; and material removal by impingement; or any combination thereof.

In a preferred embodiment, the surface of the polishing pad according to this invention is machined utilizing the following mechanical tools:

(1) a single-point tool (such as a lathe bit, milling cutter, or the like): (note that multi-toothed lathe bits, multi-ended milling tools and the like are considered single point tools in the context of this invention since they have a low fixed number of points of contact with the surface being altered).

(2) a multi-point tool (such as a wire brush (wheel or cup), a material whose surface is impregnated with an abrasive material, a grinding stone, a rasp, belt sander and the like. A multi-point tool in the context of this invention has numerous distributed points of contact with the surface being altered.)

(3) a combination of (1) and (2) above, used either simultaneously or sequentially.

Material removal from the polishing surface by impingement includes but is not limited to, sand blasting, bead blasting, grit blasting, application of high pressure fluid jets (such as water, oil, air, or the like) or any combination thereof.

Figure 3:
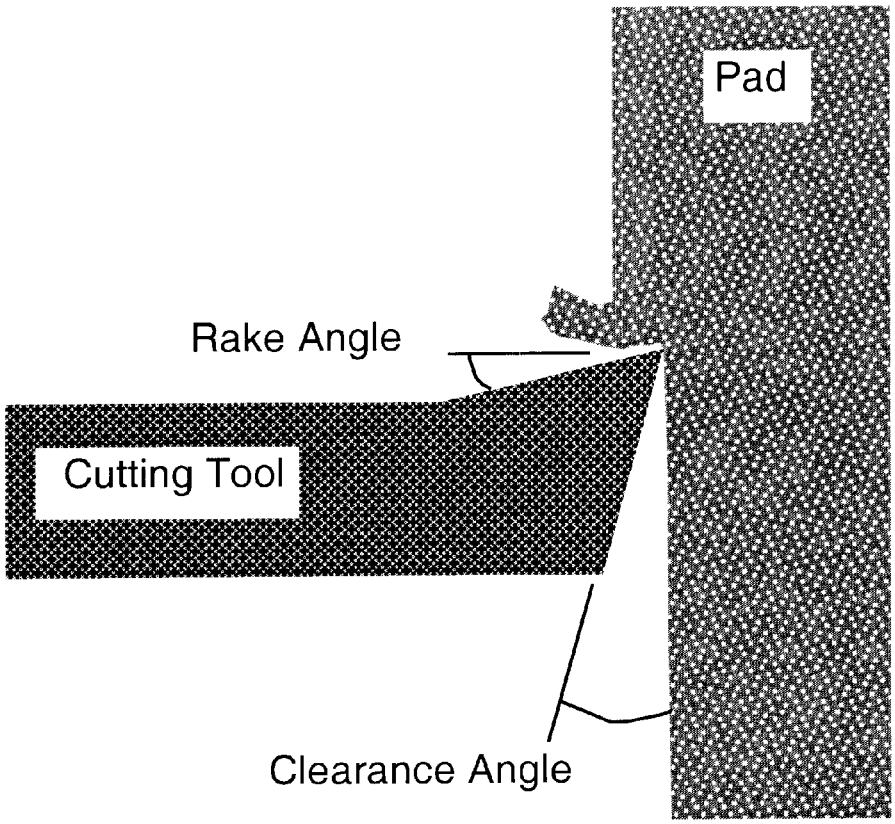
FIG. 3 is a schematic view of a single-point cutting tool used to create micro-texture according to the present invention.

In an embodiment, the micro-texture formed by method (1) employs a custom-engineered single-point high-speed cutting tool. FIG. 3 is a schematic of a single-point custom-engineered high-speed cutting tool. The cutting end of the tool is in the shape of an arc, with a preferred radius between about 0.2 mm and 500 mm. A specific micro-texture may be obtained by varying the rake and clearance angles of the tool: preferred rake angles are between 0° and 60°, and preferred clearance angles are between 0° and 60°. In a preferred embodiment, the cutting tool is moved linearly across the surface of the polishing pad while the pad is being rotated. The peak to valley height, h, is controlled through a combination of the tool's radius, r, and the feed rate of the tool across the pad as it is rotated, FR, (FR is specified by distance traveled per revolution of the pad.)

$$h = r - \sqrt{r^2 - \left(\frac{FR^2}{4}\right)}$$

This technique creates a predominant furrowed texture. The furrows can be concentric circles single spirals, or overlapping spirals, and the pattern may be either centered or not centered on the pad, or any combination thereof. The texture can be created with furrows all of the same depth or with multiple depths.

In another embodiment, the micro-texture formed by method (2) employs a disc shaped, multi-point diamond-impregnated abrasive tool. The cutting tool depicted in FIG. 3, can be shaped to provide a multi-point abrading surface containing blocky-shaped diamond grit in a size range of 40 to 400 mesh, wherein the abrading surface is a 1 cm wide ring with an outside diameter of 10 cm. Diamond impregnated tools may be specially ordered from Mandall Armor Design and Mfg., Inc, based in Phoenix, Ariz. Depending on the abrasive particle size and distribution, polishing pad surface temperature and inherent hardness of the polymeric material, obtaining a defined micro-texture depends on the velocity of the tool relative to the pad surface undergoing pre-treatment and the pressure with which the tool is applied to the pad. In an embodiment, a constant tool-to-pad surface velocity ratio in a range of about 0 to 100 is utilized to provide the micro-texture to the polishing pad of this invention.

Figure 4:
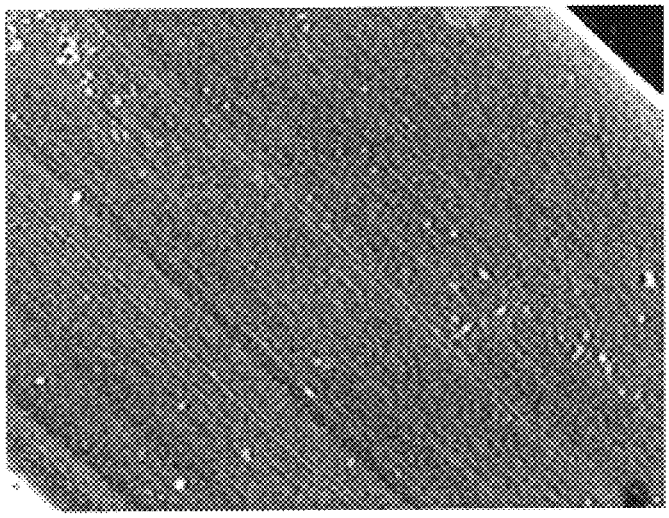
FIG. 4 is a scanning electron micrograph (SEM) at 200× magnification of the working surface of an as-manufactured, homogeneous, non-porous polishing pad without any micro-texture.
Figure 5:
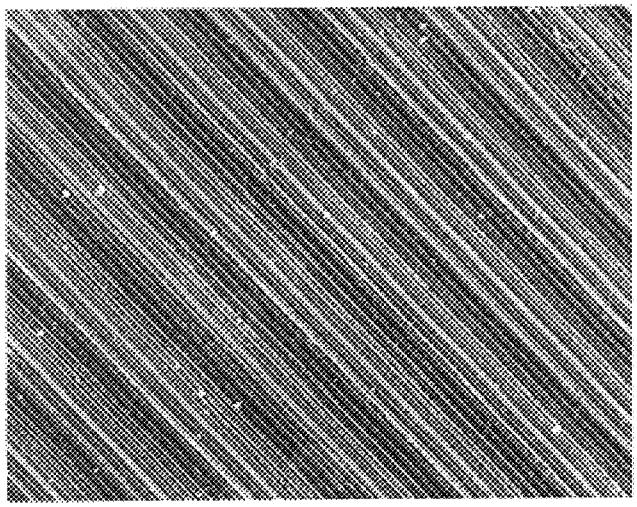
FIG. 5 is an SEM at 200× magnification of the surface of an as-manufactured polishing pad having a micro-texture utilizing a custom-engineered single-point cutting tool on a lathe.
Figure 6:
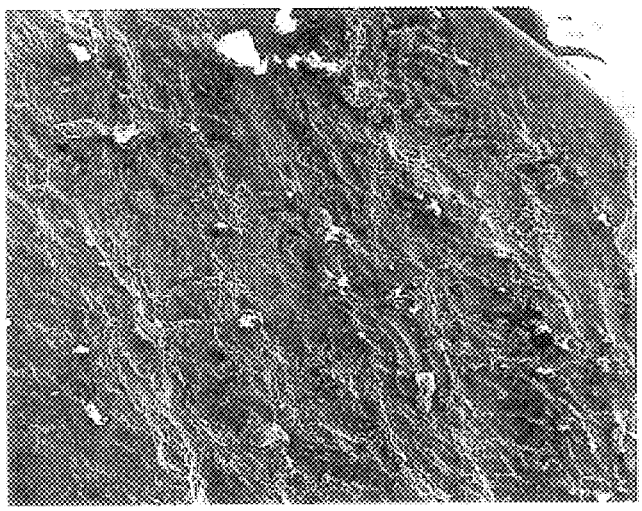
FIG. 6 is an SEM at 200× magnification of the surface of an as-manufactured polishing pad having a micro-texture utilizing a multi-point cutting tool (diamond disk) on a lathe.

Before application of a surface treatment method, the surface of an as-manufactured molded polymeric polishing pad of prior art is essentially smooth and devoid of micro-texture as shown in FIG. 4. The surface texture created by method (1) contains a uniform and well defined set of peaks (also referred to herein as protrusions) and valleys (also referred to herein as indentations) over all of the polishing surface, as shown in FIG. 5. The surface texture created by method (2) contains a statistically uniform distribution of randomly shaped and sized peaks and valleys over the entire polishing pad surface, as shown in FIG. 6.

The polishing pads of the present invention preferably comprise a solid thermoplastic polymer or thermoset polymer. The polymer may be selected from any one of a number of materials, including polyurethane, polyurea-urethane, polycarbonate, polyamide, polyacrylate, polyester and/or the like. Pads comprising polyester contain a homopolyester, a copolyester, a mixture or blend of polyesters or a polyester blend with one or more polymers other than polyester. Typical polyester manufacturing is via direct esterification of a dicarboxylic acid such as terephthalic acid (TA) with a glycol such as ethylene glycol (EG) (primary esterification to an average degree of polymerization (DP) of 2 to 3) followed by a melt or solid stage polymerization to a DP which is commercially usable (70 DP or higher). The phthalate-based polyesters are linear and cyclic polyalkylene terephthalates, particularly polyethylene terephthalate (PET), polypropylene terephthalate (PPT), polybutylene terephthalate (PBT), polyethylene-1,4-cyclohexylene-dimethylene terephthalate (PETG), polytrimethylene terephthalate (PTT), polyamide-block-PET, and other versions, e.g., random or block copolymers thereof containing one or more of the above components. Copolyesters are generally copolymers containing soft segments, e.g., polybutylene terephthalate (PBT) and hard segments, e.g., polytetramethylene ether glycol terephthalate. Phthalate-based polyester and co-polyesters are commercially available from du Pont de Nemours, Inc., Wilmington, Del., USA, under the Trevira®, Hytrel® and Riteflex® trademarks. Further details of preferred polymeric materials that exhibit an adequate surface tension and are usable in the matrix of the polishing pad of this invention are found in WO 99/07515, at Pages 6–8, herein incorporated by reference.

In an embodiment, the polishing pad of this invention is a multilayer pad, with one or more base layers wherein the base layers are either porous or non-porous and integral with a non-porous surface portion. A multi-layer or a single-layer polymeric polishing pad is typically used with a base pad to enhance polishing pad performance. Typically, base pads or sub pads are formed from foamed sheets or felts impregnated with a polymeric material.

In an embodiment, the polishing layer of the polishing pad comprises: 1. a plurality of rigid domains which resist plastic flow during polishing; and 2. a plurality of less rigid domains which are less resistant to plastic flow during polishing. Such a combination of properties provides a dual mechanism which is found to be particularly advantageous in the polishing of substrates containing silicon and metal. The hard domains tend to cause the protrusions in the polishing layer to rigorously engage the surface of the substrate being polished, whereas the soft domains tend to enhance polishing interaction between the protrusions in the polishing layer and the substrate surface being polished.

Polymers having hard and soft segments are suitable for use in the polishing pad of this invention, including ethylene copolymers, copolyester, block copolymers, polysulfone copolymers and acrylic copolymers. Hard and soft domains within the pad material can also be created: 1. by hard (benzene-ring containing) and soft (ethylene containing) segments along a polymer backbone; 2. by crystalline regions and non-crystalline regions within the pad material; 3. by alloying a hard (polysulfone) polymer with a soft (ethylene copolymer, acrylic copolymer) polymer; or 4. by combining a polymer with an organic or inorganic filler.

In another embodiment, the polishing pad of this invention includes a filler. Preferred fillers include but are not limited to those commonly used in polymer chemistry, such as gas-filled particles and inorganic materials (e.g. calcium carbonate) provided they do not unduly interfere with the performance of the polishing pad. In another embodiment, the filler is an abrasive material. Preferred abrasive materials include, but are not limited to, alumina, ceria, germania, silica, titania, zirconia, diamond, boron nitride, boron carbide, silicon carbide or mixtures thereof, either alone or interspersed in a matrix which is separate from the continuous phase of pad material. In either unfilled or filled polishing pads of this invention, the void percentage is controlled to vary in a range of about 0 to about 50%.

Polishing pads can be molded in any desired initial gauge thickness, or machined or skived from a thicker molded section of a predetermined gauge thickness. In an embodiment, the polishing pads are molded to a thickness requiring no further reduction in the overall dimension, except for some loss in surface due to pre-texturizing. The polishing pads of the present invention are made by any one of a number of polymer processing methods such as, but not limited to, casting, compression, coagulation, injection molding (including reaction injection molding), extruding, web-coating, photopolymerizing, extruding, deposition or printing (including ink-jet and screen printing), sintering, and the like. In an embodiment, the polishing pad of this invention comprises a layer wherein the layer is further composed of an overlayer and an underlayer. The overlayer, made of polymeric material, can be deposited on the underlayer by printing or photo-imaging. The underlayer could be made from an inorganic (for e.g. ceramic) material. Further details on making polishing pads by sintering are found in U.S. Pat. Nos. 6,017,265 and 6,106,754 which are herein incorporated by reference for all useful purposes.

In an alternate embodiment, the polishing pad of this invention is made by molding. In this embodiment, micro-texture is imparted to the polishing pad surface by imparting a texture to the mold surface. Various methods to impart a texture to the mold surface are described in pending application Ser. No. 09/693,401, filed on Oct. 20, 2000, herein incorporated by reference.

Pads with micro-texture machined according to this invention may be used for polishing with conventional abrasive containing slurries or abrasive-free slurries. The term polishing fluid is typically used to encompass these various types of slurries. Abrasive free-slurries are also referred to as reactive liquids. Preferred abrasive particles include, but are not limited to, alumina, ceria, germania, silica, titania, zirconia, diamond, silicon carbide, boron nitride, boron carbide or mixtures thereof. The polishing fluid typically contains oxidizers, chemicals enhancing solubility of the substrate being polished (including chelating or complexing agents), dispersants and surfactants.

One problem associated with CMP is determining when the substrate (for e.g. wafer) has been polished to the desired degree of flatness. Conventional methods for determining the endpoint of the polishing process require that polishing be stopped and that the wafer be removed from the polishing apparatus so that wafer dimensional characteristics can be determined. Stopping the operation impacts the rate of wafer production. Further, if a critical wafer dimension is found to be below a prescribed minimum, the wafer may be unusable, thereby leading to higher scrap rates and production costs. Thus, determining the polishing endpoint is critical to CMP. In one embodiment, the polymeric material used to make the polishing pad of this invention has a region wherein the polymeric material is opaque and an adjacent region wherein the polymeric material is transparent. The transparent region of the polishing pad, referred to as the "integral window", is sufficiently transmissive to an incident radiation beam and is used for polishing endpoint detection. Further details are found in U.S. Pat. No. 5,605,760 herein incorporated by reference for all useful purposes.

The polishing pad of this invention is used for polishing the surface of a substrate (workpiece). In polishing use, the pad is mounted on a polishing apparatus equipped with a holding or retention apparatus as a mounting means for mounting and securing the workpiece to the polishing apparatus. A separate means is provided for securing the polishing pad as described herein to the polishing apparatus. A drive means is provided for moving the workpiece and/or the pad relative to each other along with a means for applying and maintaining a compressive force on the workpiece to hold it against the polishing pad. The workpiece mounting means includes but is not limited to, a clamp, a set of clamps, a mounting frame attachable to the workpiece and the polishing apparatus; a platen equipped with perforations connected to a vacuum pump to hold the polishing pad; or an adhesive layer to hold the polishing pad on the platen and the workpiece to the carrier. Polishing includes biasing the substrate to be polished against the polishing surface of the polishing pad, and applying a polishing fluid with or without abrasive particles and other chemicals (complexing agents, surfactants, etc.) between the workpiece and the polishing pad. Polishing is effected by lateral motion of the substrate relative to the polishing pad. The motion may be linear or circular or a combination thereof. The initial micro-texture provided on the polishing pad surface may be regenerated during polishing use of the pad, if necessary, by mechanical means for forming micro-texture, mounted on the polishing apparatus. In known CMP, the mechanical means is typically a 100-grit conditioning disk supplied by Abrasive Technology, Inc. The micro-texture reconditioning step is preferably performed at intervals during the polishing process, either during the step of applying the substrate against the polishing pad, or more preferably during intervals when the substrate is disengaged from the polishing pad. A suitable polishing apparatus equipped with a means for re-conditioning the polishing pad surface (to regenerate micro-texture) is disclosed in U.S. Pat. No. 5,990,010.

Polishing can be terminated when the substrate achieves the desired degree of flatness utilizing end-point detection via the integral window provided in the polishing pad of this invention.

EXAMPLE 1

Prior Known Pad

A 24 in. diameter×0.052 in. thick polishing pad made according to Example 1 of U.S. Pat. No. 6,022,268 was tested. This pad is representative of a prior known prior art as-manufactured, non-preconditioned solid polymeric polishing pads.

The pad contained a molded-in macro-texture consisting of concentric grooves having a depth of 0.38 mm, a groove width of 0.25 mm and a land width (the projecting pad surface between grooves) of 0.51 mm. The pad was used to polish a series of thermal oxide (TOX) silicon wafers using an AMAT Mirra polishing machine (supplied by Applied Materials, Inc.) with ILD 1300 as the polishing slurry. ILD 1300 is a colloidal silica polishing slurry available from Rodel, Inc, based in Newark, Del.

The polishing conditions used were: pressure, 4 p.s.i.; platen speed of 93 rpm; carrier speed of 87 rpm; and a slurry flow rate of 150 ml/min. The removal rate was monitored during polishing and is plotted in FIG. 7 against accumulated polishing time. The initial polishing removal rate was about 1,500 Angstroms per minute, and attained a steady state value of 2,000 Angstroms per minute after 40 minutes of polishing time.

EXAMPLE 2

Pad of this Invention

An as-manufactured prior known pad identical to Example 1 was further processed by providing a micro-texture to the pad surface. The micro-texture was created by utilizing an Ikegai, Model AX40N lathe and a lathe bit made from high-speed tool steel with an end radius normal to the direction of the cutting surface of 0.5 mm, a rake angle of 15°, and a clearance angle of 5°, mounted in a standard bit holder. The tool was applied to the pad surface at a cut depth of 0.013 mm and translated in one pass on a linear path across the pad surface along the equator. The speed controller adjusted the rotational speed of the pad to maintain a constant tool velocity relative to the pad (in the azimuthal direction) of 6 meters/min. Cutting debris was removed using a 3.5 HP Sears Craftsman Wet/Dry Vacuum.

The micro-texture of the projecting surface, between macrogrooves was measured after pretreatment of the pad using a ZYGO New View 5000, white light interferometer with a 10× Objective lens, a 1× Zoom lens, and a magnification of 200 ×. The scan area on the pad sample was 250 square millimeters (500 μm×500 μm).

The surface characteristics of the polishing pad of this example were as follows:

Average Arithmetic Surface Roughness, Ra, of 1.6 μm;
Average Peak to Valley Roughness, Rtm, of 6.3 μm;
Core roughness depth, Rk, of 2.7 μm;
Reduced Peak Height, Rpk, from 0.97 μμm;
Reduced Valley Height, Rvk, of 1.8 μm; and
Peak density expressed as a surface area ratio, $R_{SA}$, ([Surf.Area/(Area—1)]), of 0.023.

Polishing conditions during this experiment were identical to Example 1. The removal rate was monitored again during polishing as a function of polishing time. As shown in FIG. 7, the initial removal rate was about 1,430 Angstroms per minute, and reached a steady-state value of 2,000 Angstroms per minute after 20 minutes of accumulated polishing time. Thus the pad of this invention yielded a 50% reduction in break-in time, i.e. a 50% reduction in polishing time required to attain a stable removal rate.

EXAMPLE 3

Pad of this Invention

An as-manufactured prior art pad identical to Example 1 was further processed by providing a micro-texture to the pad surface. An Ikegai, Model AX40N lathe was used in this experiment. The micro-texture was created by utilizing a 10.16 cm diameter stainless steel disk whose outer 1 cm was impregnated with 80/100 mesh diamond grit, mounted on a separate movable rotating chuck operatively connected to a pneumatic pressure cylinder. The lathe and disk assembly were coupled to a computerized speed controller which was pre-set to maintain a constant ratio of velocity between the tool and pad of 2.5 to 1. The tool was applied to the pad surface with a constant pressure of 138 kPa and translated in one pass on a linear path across the pad surface along the equator. The speed controller adjusted the rotational speed of the pad continuously, and thus compensated for the slower pad speed as the disk approached the center of the pad, and the increasing speed as the disk moved outward from the pad center, so as to maintain the constant ratio. A stream of ambient air was directed on the rotating pad as a means of cooling. Cutting debris was removed using a 3.5 HP Sears Craftsman Wet/Dry Vacuum.

The micro-texture of the projecting surface, between macrogrooves was measured after pretreatment of the pad using a ZYGO New View 5000, white light interferometer with a 10× Objective lens, a 1× Zoom lens, and a magnification of 200 ×. The scan area on the pad sample was 250 square millimeters (500 μm×500 μm).

The surface characteristics of the polishing pad of this invention were as follows:

Average Arithmetic Surface Roughness, Ra, of 1.9 μm;
Average Peak to Valley Roughness, Rtm, of 17.1 μm;
Core roughness depth, Rk, of 4.2 μm;
Reduced Peak Height, Rpk, from 2.9 μm;
Reduced Valley Height, Rvk, of 3.6 μm; and
Peak density expressed as a surface area ratio, $R_{SA}$, ([Surf.Area/(Area—1)]), of 0.265.

What is claimed is:

1. A method of forming a micro-texture on a polishing surface of a layer of a polymeric polishing pad, the polishing pad being useful for chemical mechanical polishing of wafers, comprising the steps of:

cooling the layer of the polishing pad toward a glass transition temperature of the polishing pad to form a cooled layer of the polishing pad; and machining the cooled layer of the polishing pad to generate the micro-texture in the polishing surface, and the micro-texture in the polishing surface being for chemical mechanical polishing with the polishing pad; and wherein a multi-point tool attached to a lathe is utilized to machine the cooled layer, at a tool to pad velocity ratio of about 1 to about 10.

2. The method of claim 1 wherein the cooling the layer of the polishing pad includes exposing the surface to a material selected from a group consisting of supercritical carbon dioxide, liquid nitrogen, iced water and cold liquids.

3. The method of claim 1 wherein the cooling the layer of the polishing pad includes applying a material used to lower the temperature that is chemically inactive with the surface.

4. The method of claim 1 wherein the cooling the layer of the polishing increases the storage modulus of the layer until the surface becomes more machineable.

5. A method of forming a micro-texture on a polishing surface of a layer of a polymeric polishing pad the polishing pad being useful for chemical mechanical polishing of wafers, comprising the steps of:

cooling the layer of the polishing pad toward a glass transition temperature of the polishing pad to form a cooled layer of the polishing pad;

machining the cooled layer of the polishing pad to generate the micro-texture and debris in the polishing surface, and the micro-texture in the polishing surface being for chemical mechanical polishing with the polishing pad;

removing the generated debris; and wherein a single-point tool attached to a lathe is utilized to machine the cooled layer, at a tool to pad velocity ratio in a range of about 1 to about 10.

6. The method of claim 5 wherein the a single-point tool has a blade.

7. The method of claim 1 wherein the multi-point tool has a diamond disk.

8. The method of claim 1 wherein the machining produces the micro-texture of the polishing surface having:

i. a land surface roughness, Ra, from about 0.01 $\mu$m to about 25 $\mu$m;

ii. a peak to valley roughness, Rtm, from about 2 $\mu$m to about 40 $\mu$m;

iii. a core roughness depth, Rk, from about 1 $\mu$m to about 10 $\mu$m;

iv. a reduced peak height, Rpk, from about 0.1 $\mu$m to about 5 $\mu$m;

v. a reduced valley height, Rvk, from about 0.1 $\mu$m to 10 $\mu$m; and vi. a peak density expressed as a surface area ratio, $R_{sa}$, from about 0.001 to about 2.0.

* * * * *